US005823119A

United States Patent [19]

Fischer

[11] Patent Number: 5,823,119

[45] Date of Patent: Oct. 20, 1998

[54] PULL-OUT TABLE HAVING TWO LEAF SECTIONS

[76] Inventor: Matthias Fischer, Beethovenstrasse 33a, 60325 Frankfurt, Germany

[21] Appl. No.: 781,834

[22] Filed: Jan. 10, 1997

[30] Foreign Application Priority Data

Jan. 12, 1996 [DE] Germany ..... 196 00 956.1

[51] Int. Cl.[6] ..... A47B 1/00

[52] U.S. Cl. ..... 108/87; 108/89

[58] Field of Search ..... 108/66, 68, 87, 108/88, 89, 85, 83, 74

[56] References Cited

U.S. PATENT DOCUMENTS

| | | | |
|---|---|---|---|
| 3,249 | 9/1843 | Briggs | 108/87 |
| 937,350 | 10/1909 | Whonn | 108/87 |
| 1,099,787 | 6/1914 | Chapman | 108/87 |
| 1,145,802 | 7/1915 | Schold et al. | 108/85 |
| 1,156,461 | 10/1915 | Buddle | 108/89 |
| 1,414,304 | 4/1922 | Rogginger | 108/89 X |
| 1,431,282 | 10/1922 | Bessette | 108/89 |
| 1,647,224 | 11/1927 | Henricson | 108/87 |
| 2,007,475 | 7/1935 | Miller | 108/87 X |
| 2,657,108 | 10/1953 | Leblanc | 108/85 |

FOREIGN PATENT DOCUMENTS

| | | |
|---|---|---|
| 03 11 803 | 4/1989 | European Pat. Off. . |
| 87 09 579 | 12/1987 | Germany . |
| 41 35 912 | 5/1993 | Germany . |

*Primary Examiner*—Jose V. Chen
*Attorney, Agent, or Firm*—Evenson, McKeown, Edwards & Lenahan P.L.L.C.

[57] ABSTRACT

A pull-out table having two leaf sections. Each leaf section can be displaced in parallel along in each case one curved control path in such a manner relative to a stationary pull-out axis which both leaf sections have in common that the separating edge of each leaf section is aligned along the whole movement path always at a right angle to the common stationary pull-out axis.

24 Claims, 5 Drawing Sheets

PULL-OUT TABLE HAVING TWO LEAF SECTIONS

BACKGROUND AND SUMMARY OF THE INVENTION

This invention relates to a pull-out table having two leaf sections which are disposed on a supporting structure and, in a common pull-out plane, can be moved between an inoperative position, in which the separating edges of the two leaf sections rest against one another, and a pull-out position in which the separating edges are spaced away from one another.

Such pull-out tables are generally known. For enlarging the table surface, the two leaf sections, which are disposed in a linearly movable manner on the table pedestal, are pulled apart and an additional leaf section is inserted into the created space. In order to be able to pull out each leaf section separately, relatively space-consuming guide rails are provided between the table pedestal and the leaf sections.

Since in the case of glass tables, the relatively high-expenditure construction of such pull-out tables has disadvantages from an aesthetic point of view, it is also known (German Patent Document DE 87 09 579 U1) in the case of a glass table to glue holders to the undersides of the glass leaf sections by means of which the glass leaf sections are supported on guide rails of the supporting structure of the pull-out table. The length of the guide rails requires the bearing of these guide rails on a supporting frame which requires a relatively large amount of space.

From German Patent Document DE 41 35 912 C2, a swivel table is known in the case of which the leaf sections are held on swivellable supporting arms. The supporting arms, in turn, are disposed on a supporting structure in the form of a pedestal. However, for changing the size of the table, this swivel table requires a relatively large free space because, when swivelling in or out, the leaf sections sweep over a large surface in space which must be kept free. The changing of the table size therefore requires relatively high effort because, on the one hand, the table must be placed so far in the center of a room that the corresponding swivel movements of the leaf sections are possible. On the other hand, chairs and other types of seats must be removed so far from the swivel table that, during the swivelling in or out of the leaf sections, they do not cross and therefore block the path of the movement of the leaf sections. Particularly in the case of narrow space conditions, an enlargement of the table may not be possible if oblong table leaves are involved.

It is therefore an object of the invention to provide a pull-out table of the initially mentioned type which, on the one hand, permits a plurality of design possibilities and, on the other hand, even in narrow space conditions, can be changed with respect to its size at relatively low effort.

This and other objects have been achieved according to the present invention in which each leaf section can be displaced in parallel along one curved control path respectively relative to a stationary pull-out axis which both leaf sections have in common such that the separating edge of each leaf section is aligned along the whole path of the movement at a right angle with respect to the common stationary pull-out axis. As a result of the solution according to the invention, an extremely simple pull-out guide for the leaf sections is provided which requires a relatively small space particularly for the bearing on the supporting structure of the pull-out table, for example, on a pedestal. As a result, because of the compact functional components, the pull-out table can have a largely free design. Since the leaf sections are displaced in parallel along a single common pull-out axis without sweeping over a large surface in space, during the pull-out or during the sliding-together, the size of the table can easily be changed even in the case of a relatively limited lateral space. The simple design of the pull-out apparatus permits particularly also the construction of the leaf sections of a transparent material, such as glass.

In an embodiment of the invention, the leaf sections are movably disposed by means of one parallelogram guide respectively. As a result, the leaf sections are each disposed to be rotatable about at least two points of rotation. Because of this development, a parallel displacement for the leaf sections is obtained which has a particularly simple construction and is reasonable in cost. As the result of the bearing of the leaf sections by means of parallelogram guides, a control path in the form of a circular-arc-shaped path curve is obtained for the leaf sections.

In a further development, the two parallelogram guides are coupled with one another by means of a synchronous coupling in such a manner that both leaf sections can be simultaneously moved by the same amounts. By means of the synchronous coupling, it is possible to pull apart or slide together both leaf sections simultaneously by means of an operation of only one leaf section.

In a further development of the invention, the stationary bearing points of both parallelogram guides are situated on the common pull-out axis. As a result, it is ensured that the parallelogram guides are arranged on the supporting structure in a spatially compact manner.

In a further development of the invention, the two parallelogram guides are situated opposite one another point-symmetrically with respect to a perpendicular center axis of the supporting structure, and, as a synchronous coupling, the two parallelogram control arms of the opposite parallelogram guides which are disposed about the perpendicular center axis and are aligned with one another are connected with one another in one piece to form a cross traverse which can be rotated about the center axis. As a result, a particularly advantageous arrangement of the parallelogram guides is achieved which requires a further reduced space. By means of the cross traverse which connects the two parallelogram guides in one piece with one another, in addition, an extremely simple and nevertheless operationally reliable synchronous coupling is created. The arrangement of the parallelogram guides as well as of the cross traverse symmetrically with respect to the perpendicular center axis permits the use of the supporting structure for the pull-out table in the form of a central table pedestal. This results in manifold design possibilities for the table pedestal as well as for the selection of the shape and the material of the leaf sections.

In a further development of the invention, the cross traverse is disposed—relative to the perpendicular center axis—in an axially play-free rotatable manner. As a result, an extremely exact bearing is provided which creates a high stability for the parallelogram guides and the supporting arms carrying the leaf sections. As the result of this further development, heavy leaf sections made of glass or stone can therefore also be securely moved.

In a further development of the invention, the cross traverse is disposed on the pedestal by means of an axial bearing which is slightly axially prestressed by an axial load element, in which case a fixing device for securing the adjusted preload is assigned to the axial load element. As the result, an axially play-free bearing of the cross traverse is provided by means of simple devices.

In a further development of the invention, a supporting arm is provided for each leaf section which is pivotally connected to the cross traverse and which is provided with a supporting plate for holding the leaf section. As a result, only a single supporting plate is required for the holding of the respective leaf section, whereby essentially free design possibilities are provided for the leaf section. This further development is advantageous particularly for leaf sections made of glass.

In a further development of the invention, one end stop respectively is assigned to both parallelogram guides for the respective pull-out position. As a result, the movement possibilities of the leaf sections are limited to defined areas, whereby in particular an exact alignment of the leaf sections with respect to the one another is achieved in the inoperative as well as in the pull-out position.

In a further development of the invention with a supporting arm for each leaf section which is disposed on a holder by means of a pivot bearing to be rotatable about a perpendicular axis of rotation, the pivot bearing for the supporting arm is constructed as a double axial bearing. As a result, the supporting arm is disposed in a particularly stable manner, whereby the bearing can also without any problems absorb high bending and tilting moments which result from heavy leaf sections, such as glass or stone leaves.

In a further development of the invention, the double axial bearing has a lower axial bearing unit below the holder and an upper axial bearing unit above the holder. By means of the two axial bearing units, the holder is framed in a stable manner, whereby the supporting arm can also support heavy leaf sections and is nevertheless disposed in a stable manner on the holder. Preferably a holder is provided in the form of an above-described cross traverse.

In a further development of the invention, the leaf section rests in the area of the supporting plate on at least three adjusting points which are arranged concentrically with respect to a fixing element, in which case the adjusting points are axially adjustable, and the fixing element in the locked condition presses the supporting plate against the adjusting points. As a result, an exact alignment of the leaf sections is ensured with respect to one another as well as with respect to the space.

Other objects, advantages and novel features of the present invention will become apparent from the following detailed description of the invention when considered in conjunction with the accompanying drawings.

DETAILED DESCRIPTION OF THE DRAWINGS

Figure 1:
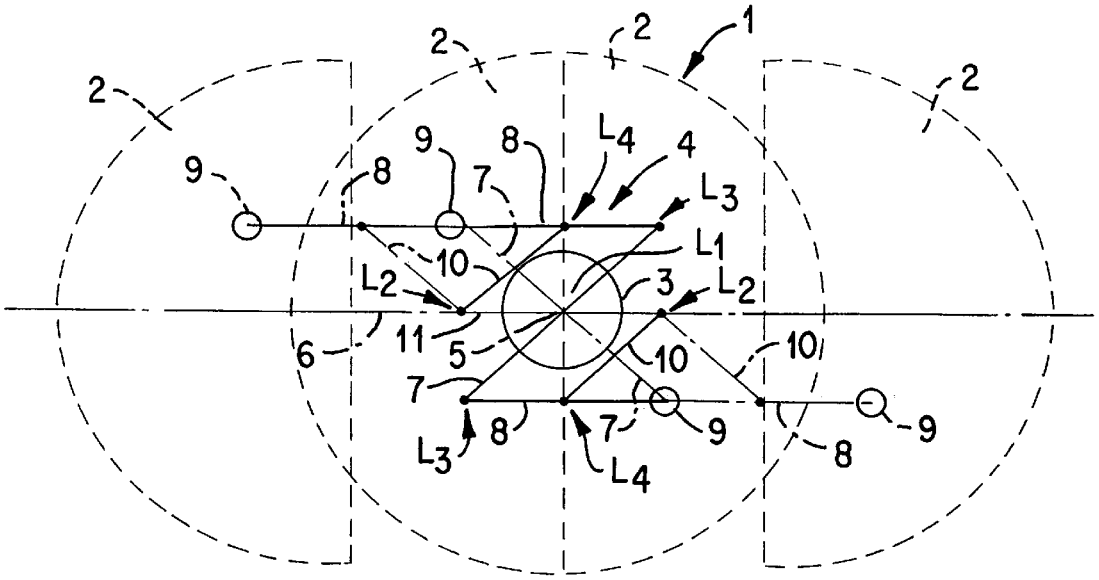
FIG. 1 is a schematic top view of a pull-out table according to a preferred embodiment of the present invention.
Figure 2:
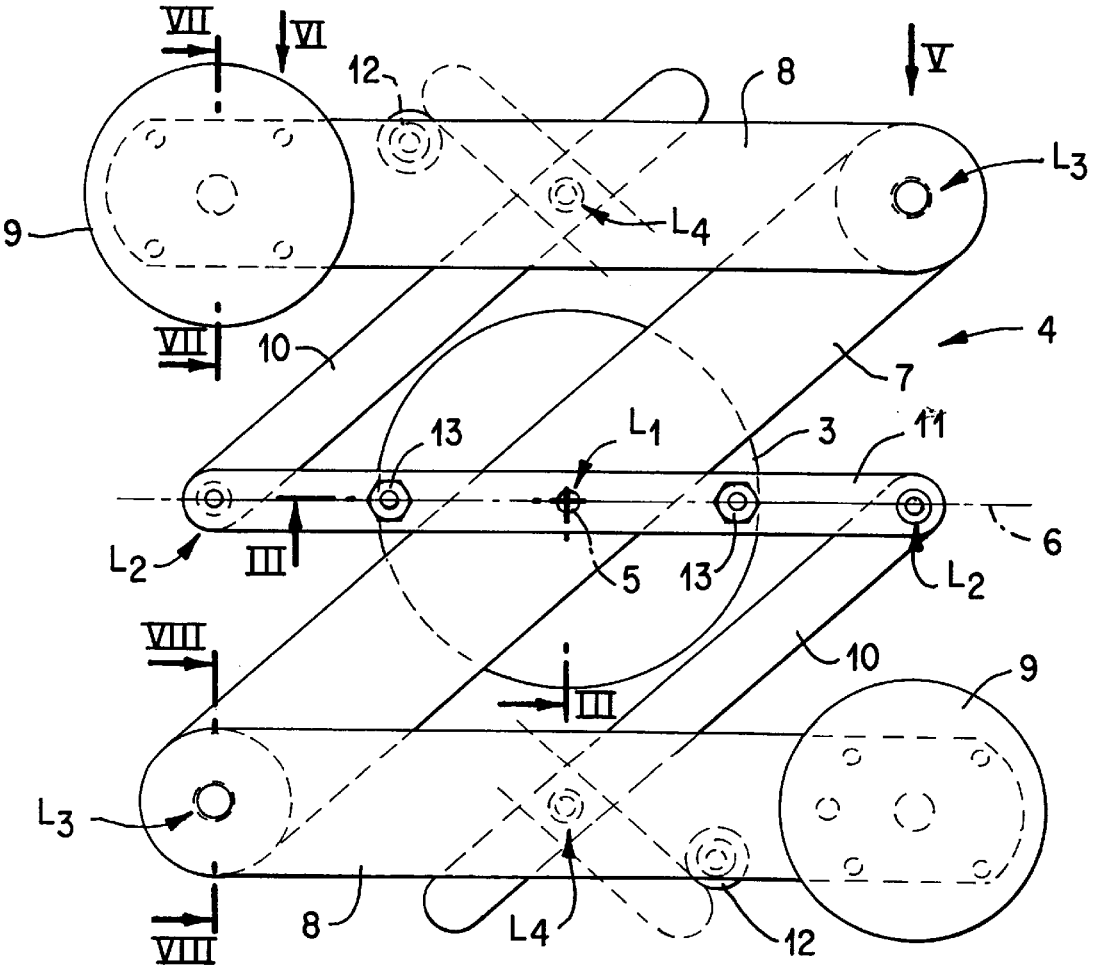
FIG. 2 is an enlarged top view of the pull-out apparatus of the pull-out table according to FIG. 1.
Figure 3:
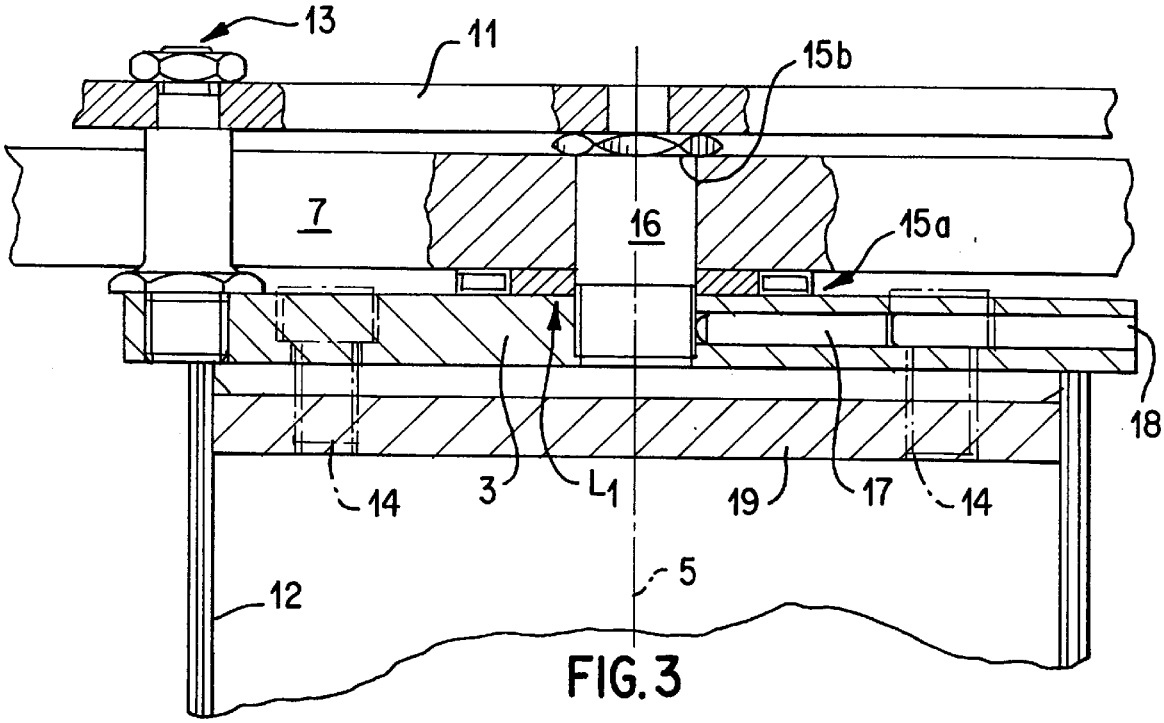
FIG. 3 is a sectional view of the pull-out apparatus according to FIG. 2 along the intersection line III—III in FIG. 2.
Figure 4:
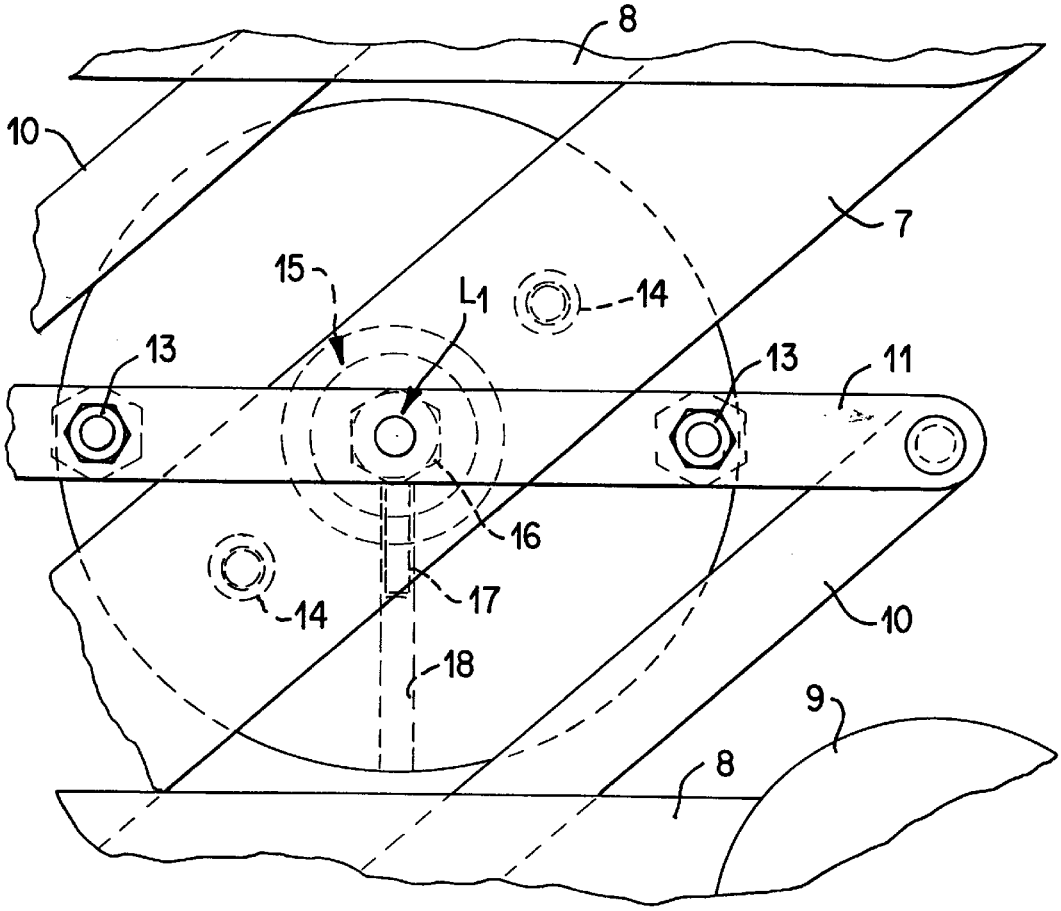
FIG. 4 is an enlarged top view of a central part of the pull-out apparatus of FIG. 2 according to the illustrated area in FIG. 3.

A pull-out table 1, as described in the following in reference to FIGS. 1 to 13, has two leaf sections 2 which are movably disposed on a supporting structure 3, 12 and together form the table surface of the pull-out table 1 in its inoperative position. Both leaf sections 2 have a semicircular leaf surface, being aligned with respect to one another such that, in the inoperative position, they complement one another to form a closed, circular table surface. Both leaf sections 2 are made of glass. By means of a pull-out apparatus 4, which will be described in detail in the following, both leaf sections 2 are disposed on a table pedestal 3, 12 representing the supporting structure of the pull-out table 1. In their inoperative position, the two leaf sections 2 are aligned concentrically with respect to a central, perpendicular center axis 5 which simultaneously represents the longitudinal center axis of the table pedestal 3, 12.

In their inoperative position, the leaf sections 2 are also arranged asymmetrically with respect to a horizontal pull-out axis 6 which intersects the center axis 5. By means of the pull-out apparatus 4, the leaf sections 2 can be pulled along this pull-out axis 6 out of the inoperative position into their pull-out position (illustrated by a broken line). In this pull-out position, both leaf sections 2 are removed in each case by the same amount from the center axis 5. Also in the pull-out position, the leaf sections 2 are aligned coaxially and axially symmetrically with respect to the pull-out axis 6. In this pull-out position, in which the leaf sections 2 leave a distance between their separating edges 2*a* resting against one another in the inoperative position, an insertion leaf section 2*b* (FIG. 12 and 13) can inserted in the formed free space, which insertion leaf section 2*b* is adapted to the dimensions of the leaf sections 2. In the inoperative position of the leaf sections 2 and of the pull-out table 1, the insertion leaf is disposed separately from the pull-out table 1. Naturally, it is also possible to insert several insertion sections between the leaf sections 2 as soon as these are in their pull-out position.

In order to pull the two leaf sections 2 out of their inoperative position into the pull-out position in which they have a distance from one another or push them back again from this pull-out position into the inoperative position, by means of one parallelogram guide respectively, which will be explained in detail in the following, each leaf section 2 is disposed on the table pedestal 3. The stationary bearing points ($L_1$ and $L_2$) of each parallelogram guide are positioned on the pull-out axis 6 so that the two parallelogram control arms of each parallelogram guide each rotate about these stationary bearing points ($L_1$ and $L_2$) The two parallelogram guides project from the pull-out axis 6 to opposite sides in order not to interfere with one another during their pull-out movement. The two parallelogram guides for the two leaf sections 2 are also synchronously coupled with one another in a particularly simple manner in that the stationary bearing points ($L_1$) for the pertaining parallelogram control arms of both parallelogram guides are combined to a common bearing point ($L_1$) and are arranged exactly at the level of the center axis 5. The two parallelogram control arms, which are disposed in the stationary bearing point ($L_1$), project in a mutually aligned manner to opposite sides point—symmetrically away from the center axis 5. As the synchronous coupling, these two parallelogram control arms are connected with one another in a simple manner in one piece in that they form a cross traverse 7 which intersects the center axis 5 and which is disposed coaxially with respect to the center axis 5 in the stationary bearing point ($L_1$). The two other stationary bearing points ($L_2$) for the respective other parallelogram control arms of the two parallelogram guides are spaced by the same amounts on the pull-out axis 6 with respect to opposite sides from the center axis 5. The parallelogram control arms disposed in the bearing points ($L_2$) represent coupling rods 10, in which case the two coupling rods 10 are disposed in the area of the bearing points ($L_2$) on an extension arm 11 which extends along the pull-out axis 6 and is fixed by means of two screwed connections 13 (FIG. 2) on the table pedestal 3.

In order to achieve an exact alignment—with respect to the pull-out axis 6—in the inoperative position as well as in the pull-out position and thus to avoid an offset positioning of the leaf sections with respect to one another, the angle sizes of the parallelogram control arms relative to the pull-out axis 6 are in each case identical in the inoperative as well as in the pull-out position and thus in the two end positions.

On the free ends of the parallelogram control arms in the form of the coupling rods 10 and of the cross traverse 7 of both parallelogram guides, at one bearing point ($L_3$ and $L_4$) respectively which can be displaced in the pull-out plane, one supporting arm 8 respectively is disposed which is in each case aligned axially in parallel to the pull-out axis 6. Each supporting arm 8 has an extension on whose free end a supporting plate 9 is provided on which the pertaining leaf section 2 is fastened. In the illustrated embodiment, the two leaf sections 2 are each glued flatly to the supporting plate 9. Each supporting arm 8 and the pertaining supporting plate 9 reach eccentrically under the pertaining leaf section 2, in which case, however, the glued connection is designed to be so stable that also the eccentric support of the leaf section 2 by the pertaining supporting arm 8 ensures a secure holding of the respective leaf section 2 on the supporting arm 8.

Figure 6:
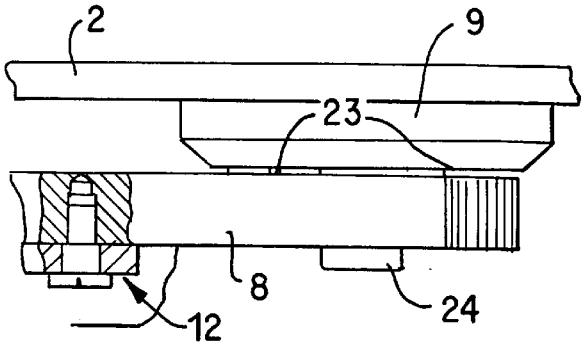
FIG. 6 is a view of the fixing device of a supporting plate for holding the leaf section on the supporting arm.

The cross traverse 7 and the two supporting arms 8 are each constructed as stable metal supports, in which case the supporting arms 8 are disposed in the area of the bearing points ($L_3$) in the extremely robust manner described in the following on the cross traverse 7, and the cross traverse 7, in turn, is disposed in an extremely robust manner in the bearing point ($L_1$) on the table pedestal 3. Since the carrying and supporting function for the leaf sections 2 is taken over almost completely by the supporting arms 8 and the cross traverse 7, the coupling rods 10 and the extension arm 11 are constructed to be correspondingly weaker. The coupling rods 10 and the extension arm 11 are also made of metal but have a much smaller width and thickness than the cross traverse 7 and the supporting arms 8. The coupling rods 10 are used only for the parallel displacement of the two supporting arms 8 but have almost no carrying or supporting function for the supporting arms 8. On each supporting arm 8, one stop 12 respectively is provided in the form of a rubber washer which is fastened in the movement path of the free lengthening of the respective coupling rods 10 on the supporting arm 8 and therefore limits the parallel displacement of the respective supporting arm 8 in that the coupling rod 10 will come to rest against this stop 12 in the pull-out position. The stop 12 is positioned on the respective supporting arm 8 in such a manner that the size of the angle of the cross traverse 7 and of the coupling rods 10 relative to the pull-out axis 6 in the inoperative position is identical with the angle size of the cross traverse 7 and the coupling rods 10 in the pull-out position. No separate stop is provided for the inoperative position because in this inoperative position, the separating edges of the two leaf sections 2 rest flush against one another anyhow and therefore form a direct stop. Since the two parallelogram guides for the two leaf sections 2 are synchronously coupled with one another, a single stop 12 would also be sufficient in order to define the pull-out position of the leaf sections 2. The fastening of the rubber washer used as the stop 12 on the supporting arm 8 takes place by means of a screwed connection, as illustrated in FIG. 6.

The cross traverse 7 is disposed in the bearing point ($L_1$) by means of an axial roller bearing 15*a* on the table pedestal 3, 12, the axial roller bearing 15*a* being aligned concentrically with respect to the perpendicular center axis 5. The axial roller bearing 15*a* rests on a pedestal plate 3 of the table pedestal 3, 12 which forms the upper end of the table pedestal 3 and rests on the upper edge of the actual pedestal area 12. The pedestal area 12 is constructed as a hollow cylinder and consists of metal. Below the pedestal plate 3, a cover plate 19 is welded into the pedestal cylinder 12, on which cover plate 19 the pedestal plate 3 is fixed in a stable manner by means of screwed connections 14 in the form of tension bolts. In order to be able to adjust the play of the axial roller bearing 15*a* and to ensure a fixing of the position of the cross traverse 7 relative to the center axis 5, the cross traverse 7 is penetrated by a stud 16, in which case the stud 16 used as the bearing stud is disposed in a corresponding passage bore of the cross traverse 7 by means of a loose fit. The threaded shaft of the stud 16 engages in a threaded bore in the pedestal plate 3. A shim ring 15*b*, which is inserted between the top side of the cross traverse 7 and the bottom side of the screw head 15*b*, is assigned to the screw head of the stud 16. The stud 16 is tightened and prestressed in the pedestal plate 3 to such an extent that the cross traverse 7 is pressed axially without play onto the axial roller bearing 15*a*. However, at the same time, the tightening of the stud 16 is selected to be so moderate that no self-locking of the bearing occurs and that, in the area of the shim ring 15*b*, a secure sliding bearing is ensured between the screw head and the top side of the cross traverse 7. For the fixing of the precise adjusting of the axial bearing in the area of the bearing point ($L_1$), a protection against torsion in the form of a fixing point 17 is assigned to the stud 16, which fixing point 17 can be screwed radially with respect to the center axis 5 into a corresponding threaded bore 18 of the pedestal plate 3 and, when screwed into the threaded bore 18, presses by means of its point into the threaded shaft of the stud 16. This results in a form-locking protection against torsion for the stud 16 which can be released again in a simple manner by a corresponding unscrewing of the fixing point 17.

The extension arm 11 is guided directly above the screw head of the stud 16 diagonally by way of the cross traverse 7 and is screwed by means of two screwed connections 13 to the pedestal plate 3. Each screwed connection 13 has a respective stud constructed in the form of a spacer which supports the extension arm 11 at such a large distance from the pedestal plate 3 that the extension arm 11 will not be in contact with the cross traverse 7. The extension arm 11 is provided with a passage bore which is coaxial to the center axis 5 and which, in the illustrated embodiment, has no function. In the case of an embodiment which is not shown, this bore is used for receiving a lengthening of the screw head of the stud 16, whereby a further improved coaxial alignment of the stud 16 and of the cross traverse 7 takes place relative to the center axis 5. In this embodiment, the lengthening of the screw head is held by means of a loose fit in the bore of the extension arm 11 in order to, also when the extension arm 11 is already mounted, still permit an adjusting of the axial bearing of the bearing point ($L_1$).

Figure 5:
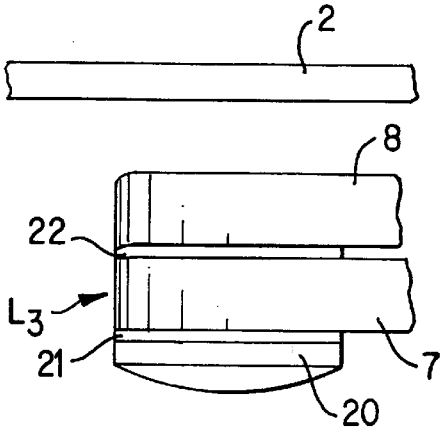
FIG. 5 is a lateral view of a cut-out of the pull-out table according to FIGS. 1 to 4 at the level of the bearing of a supporting arm on a cross traverse.
Figure 8:
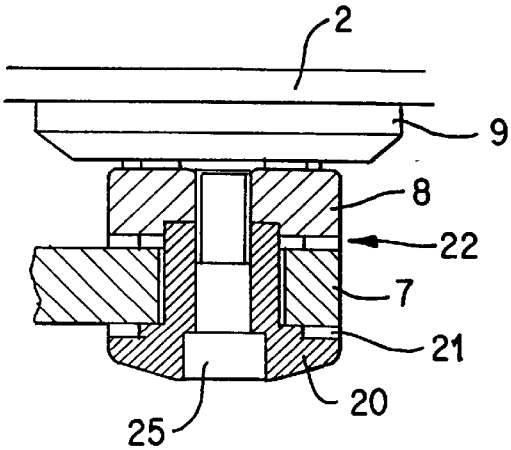
FIG. 8 is another sectional view of the pull-out table according to FIGS. 1 to 7 along the intersection line VIII—VIII in FIG. 2.

In order to absorb tilting moments in the area of the bearing points ($L_3$) of the supporting arm 8 relative to the cross traverse 7 without influencing the smooth movement of the bearing, each supporting arm 8 is disposed on the cross traverse 7 by means of a double axial bearing 21, 22 (FIG. 5 and 8). The double axial bearing has a lower axial bearing unit 21 and an upper axial bearing unit 22 which flank the cross traverse 7 on its top side and on its bottom side. By means of this double axial bearing, an extremely stable bearing of the supporting arm 8 on the cross traverse 7 is provided, in which case the lower axial bearing unit 21 absorbs tilting moments in one direction and the upper axial bearing unit 22 absorbs tilting moments in the opposite direction. The fixing of the positions of the axial bearing units 21, 22 takes place by a plug-type bearing block 20 which is connected with the supporting arm 8 by means of a tension screw 25 which engages in a corresponding threaded bore of the supporting arm 8. The providing of a space-saving and aesthetically attractive cross traverse for the bearing of the supporting arms is not limited to the use in a pull-out table according to the described embodiment. In the same manner, this construction can also be used for other pieces of furniture and particularly also for a swivel table, as known from German Patent Document DE 41 35 912 C2. The same applies to the double axial bearing of the supporting arms on the cross traverse.

Figure 7:
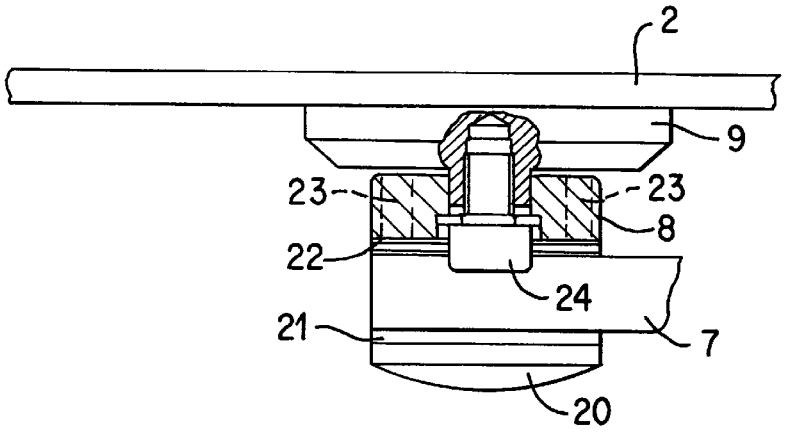
FIG. 7 is a sectional view of the pull-out table according to FIG. 1 to 6 along the intersection line VII—VII in FIG. 2.

Each leaf section 2 is glued flatly on the pertaining supporting plate 9 (FIG. 6 and 7). The supporting plate 9 is supported by the supporting arm 8, in which case an adjusting device 23, 24 is in addition assigned to the supporting plate 9, by means of which adjusting device 23, 24 the supporting plate 9 and thus the leaf section 2 can be aligned relative to the supporting arm 8 and thus also with respect to the adjacent leaf section 2 in its horizontal alignment. For this purpose, the supporting plate 9 is supported on the points of four threaded pins 23 which, in a mutually spaced manner, are aligned perpendicularly in corresponding threaded bores in the supporting arm 8. On their front ends situated opposite the points, the threaded pins 23 are provided with tool application surfaces by means of which the threaded pins 23 can be adjusted. The four threaded bores in the supporting arm 8 are each open in the direction of the top side and the bottom side of the supporting arm 9 so that the threaded pins 23 can project through these threaded bores. The supporting plate 9 has a journal-type extension which engages in a corresponding stepped bore in the supporting arm 8 and is provided with a threaded bore in which a tension screw 24 engages from below. The tension screw 24 is inserted from below into the supporting arm 8 and is supported by means of its screw head on a supporting disk not shown in detail. The screw head 24 is provided with tool application surfaces, particularly with wrench surfaces. For adjusting the supporting plate 9 relative to the supporting arm 8 and thus for adjusting the horizontal alignment of the leaf section 2 relative to the adjacent leaf section 2, while the tension screw is only loosely tightened, the four threaded pins 23 are screwed from below against the supporting plate 9 until the exact positioning of the leaf section 2 is reached. The fixing of this adjusted position of the leaf section 9 takes place in a simple manner by the tightening of the tension screw 24, whereby the supporting plate 9 is pressed against the points of the threaded pins 23. The points of these threaded pins 23 form a statically determined, stable support for the supporting plate 9. Another adjustment takes place in a simple manner by releasing the tension screw 24, by resetting the threaded pins 23 and by tightening the tension screw 24.

Figure 9:
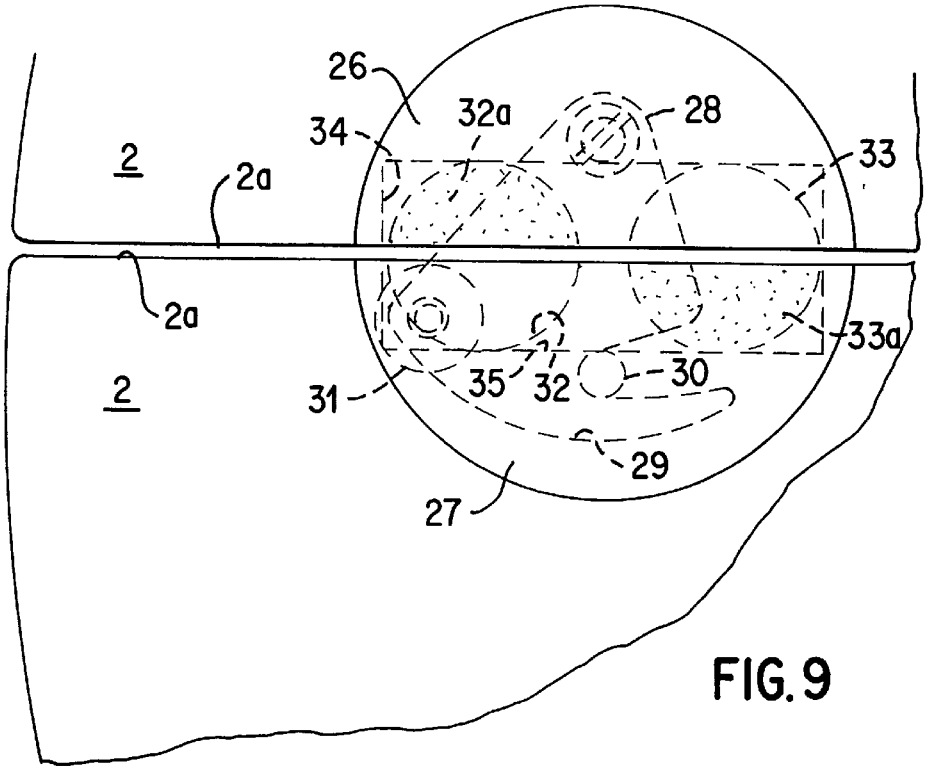
FIG. 9 is an enlarged top view of a locking arrangement for the mutual locking of the two leaf sections in their inoperative position.
Figure 10:
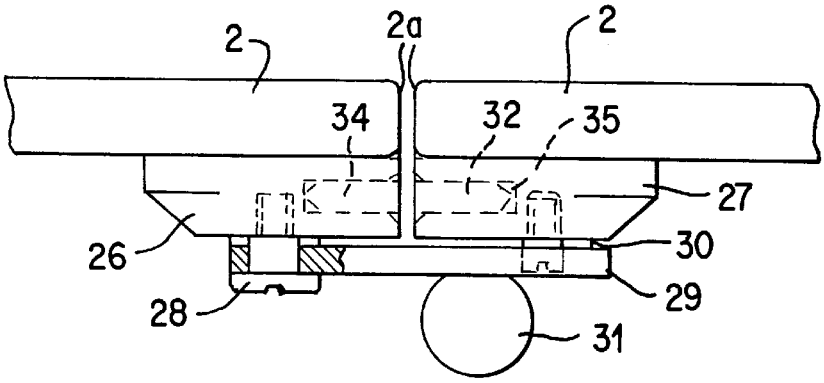
FIG. 10 is a lateral view of the locking arrangement according to FIG. 9.
Figure 11:
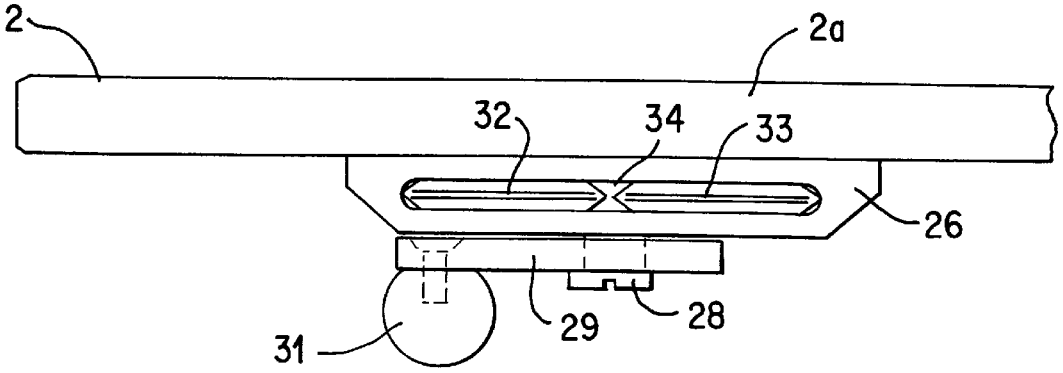
FIG. 11 is a frontal view of the one part of the locking arrangement according to FIG. 9 and 10 which is assigned to a leaf section.
Figure 12:
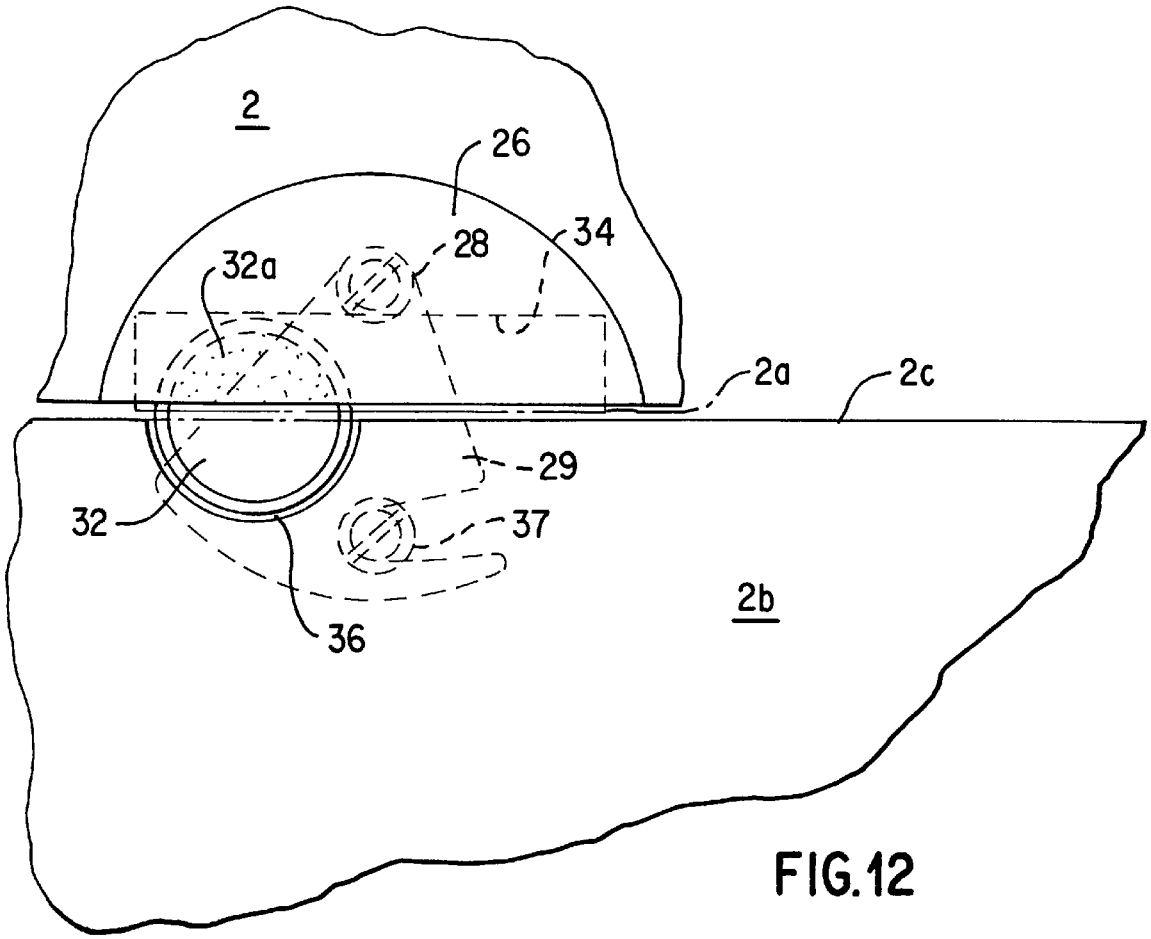
FIG. 12 is an also enlarged top view of another locking arrangement similar to FIGS. 9 to 11 between an inserted leaf section and a stationarily disposed leaf section.
Figure 13:
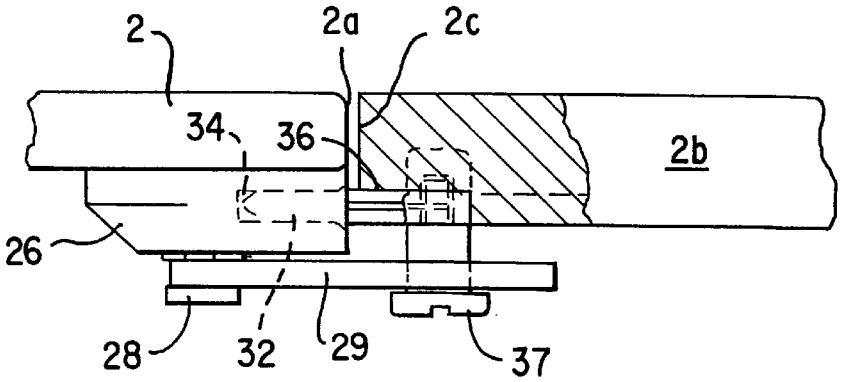
FIG. 13 is a partially cut-open lateral view of the locking arrangement according to FIG. 12.

In order to, on the one hand, lock the two leaf sections 2 to one another in the inoperative position of the pull-out table 1 and, on the other hand, hold and support the two leaf sections 2 also in the area of the outer edges mutually at the same level, a locking arrangement, which will be described in detail in the following in reference to FIGS. 9 and 11, is provided for the leaf sections 2. For this purpose, one semicircular supporting disk 26, 27 respectively is glued to the underside of each leaf section 2, in which case the linear front edges of the two supporting disks 26, 27 of each leaf section 2 are aligned with the separating edges 2*a* of each leaf section 2. In each supporting disk 26, 27, a groove-type indentation 34, 35 is provided which is open toward the forward front edge. In each indentation 34, 35 of the two supporting disks 26, 27, one circular positioning disk 32, 33 respectively is glued in, in which case the two positioning disks 32, 33 are dimensioned such that, by means of one half, they project to the bottom of the respective indentation 34, 35 and are glued into this indentation, and by means of their other half, project horizontally toward the front from the forward front edge of the respective supporting disk 26, 27 and thus also the respective separating edge 2*a*. The two positioning disks 32 and 33 in the opposite indentations 34, 35 are therefore in each case glued by means of their half 32*a* or 33*a* into the pertaining indentation 34, 35 and in this case are arranged to be offset with respect to one another such that the free halves of the positioning disks 32, 33 which project toward the front, in the inoperative position of the two leaf sections 2, are arranged side-by-side. For this purpose, the width of each indentation 34, 35 is selected such that, next to the respective glued-in half 32*a*, 33*a* of the respective positioning disk 32, 33, a sufficiently large space remains in order to be able to accommodate the respective half of the opposite positioning disk 32, 33. The positioning disks 32, 33 are in each case provided with a surrounding edge which tapers conically to the top side as well as to the bottom side of the respective positioning disk 32, 33. As a result, stop edges are created which facilitate the sliding of the positioning disks 32, 33 into the indentations 34, 35 of the opposite supporting disks 26, 27, particularly in the case of leaf sections 2 which are not aligned precisely perpendicularly or horizontally. By means of the two positioning disks 32, 33, which can be slid reciprocally into respective opposite indentations 34, 35 of the opposite supporting disk 26, 27, a precise alignment of the opposite leaf sections 2 is created with respect to one another. In order to fix this precisely aligned inoperative position of the two leaf sections 2 with respect to one another, a locking device 28, 29, 30, 31 is also assigned to the two supporting disks 26, 27, which locking device locks the two leaf sections 2 with respect to one another. The locking device has a hookshaped locking bar 29 which is rotatably disposed on the bottom side of the supporting disk 26 by means of a bearing bolt 28. A locking bolt 30 on the underside of the opposite supporting disk 27 is assigned to this locking bar 29 which reaching behind the locking bolt 30 in the locked condition. For a simple manual operating of the locking device, a gripping knob 31 is fastened on the underside of the locking bar 29.

In order to be able to also lock a corresponding insertion leaf section 2*b* in the pull-out position of the leaf sections 2 with the two leaf sections 2 and to support the insertion leaf section 2*b* from below in the area of this locking, a semi-circular sinking is assigned to the supporting disk 26 of the leaf section 2 in the area of the opposite front edge 2*c* of the insertion leaf section 2*b*, which sinking is provided on the underside of the insertion leaf section 2*b*. In addition, a locking bolt 37 is anchored in the underside of the insertion leaf section 2*b* behind which the locking bar 29 of the supporting disk 26 can reach. The positioning disk 32, which is glued in a stable manner into the indentation 34 of the supporting disk 26, projects into the sinking 36 of the insertion leaf section 2*b* which is open in the downward direction and toward the front edge 2*c* and therefore supports the insertion leaf section 2*b* from below. As a result, the insertion leaf section 2*b* is prevented from sagging in the edge area. In addition, the transition is stabilized between the leaf section 2 and the insertion leaf section 2*b*. In the case of the illustrated embodiment, the insertion leaf section 2*b* is not made of glass as the leaf sections 2 but of a non-transparent material, particularly of wood. However, the insertion leaf section 2*b* can also be made of glass in the same manner.

The solution according to the invention described above by means of the drawings is not limited to a table but can also be used for other pieces of furniture, such as sideboards, shelves or similar pieces.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A furniture article, comprising:

two leaf sections, each said leaf section having a respective separating edge;

a supporting structure operatively connected with said leaf sections such that said leaf sections can be moved between an inoperative position, in which the separating edges of the two leaf sections rest against one another, and a pull-out position in which the separating edges are spaced away from one another in a direction defining a stationary pull-out axis, said supporting structure being arranged and configured such that each leaf section can be displaced in parallel along a curved control path respectively relative to the stationary pull-out axis which both leaf sections have in common such that the separating edge of each leaf section is aligned along the whole curved control path at a right angle to the common stationary pull-out axis, said supporting structure including two supporting arms fixedly coupled to the two leaf sections, respectively, each of the supporting arms being rotatably coupled to at least two guiding elements which maintain said supporting arms parallel to said pull-out axis throughout movement between said inoperative position and said pull-out position.

2. A furniture article according to claim 1, wherein the supporting structure defines a pair of parallelogram guides, each of the leaf sections being movably disposed on a respective one of said parallelogram guides.

3. A furniture article according to claim 2, wherein the two parallelogram guides are connected with one another by means of a synchronous coupling in such a manner that both leaf sections can be moved simultaneously by the same amounts.

4. A furniture article according to claim 1, wherein each of the parallelogram guides have a first stationary bearing point at a center axis of the supporting structure and a second bearing point on the pull-out axis.

5. A furniture article according to claim 4, wherein at least one of the two stationary bearing points of one of the two parallelogram guides is combined with the corresponding stationary bearing point of the other parallelogram guide and the parallelogram guides are rigidly coupled with one another proximate the at least one stationary bearing point.

6. A furniture article according to claim 4, wherein at least one end stop is arranged to engage each of the parallelogram guides in the respective pull-out position.

7. A furniture article according to claim 5, wherein the two parallelogram guides are situated opposite one another point-symmetrically with respect to a perpendicular center axis of the supporting structure and, as a synchronous coupling, two of said supporting arms of the parallelogram guides, which are stationarily disposed about the perpendicular center axis and are aligned with one another, are connected with one another in one piece to form a cross traverse which can be rotated about the center axis.

8. A furniture article according to claim 7, wherein the cross traverse is disposed, relative to the perpendicular center axis, axially rotatably without play on the supporting structure.

9. A furniture article according to claim 8, wherein the cross traverse is supported on the supporting structure by an axial bearing which is slightly axially prestressed by an axial load element, a fixing device for securing the adjusted preload being operatively connected to the axial load element.

10. A furniture article according to claim 1, wherein each supporting arm is provided with a supporting plate for holding the leaf section.

11. A furniture article according to claim 10, wherein the supporting arm for each leaf section is disposed via a pivot bearing on one of the guiding elements in a rotatable manner about a perpendicular axis of rotation, wherein the pivot bearing for the supporting arm is constructed as a double axial bearing.

12. A furniture article according to claim 1, wherein a locking and supporting device for the respective adjacent leaf section is arranged proximate the separating edge of at least one leaf section.

13. A furniture article according to claim 11, wherein the double axial bearing has a lower axial bearing unit below the respective guiding element and an upper axial bearing unit above the respective guiding element.

14. A furniture article according to claim 13, wherein the leaf section rests proximate the supporting plate on at least three adjusting points arranged concentrically with respect to a releasable fixing element, the adjusting points being axially adjustable and the fixing element, in the locked condition, pressing the supporting plate against the adjusting points.

15. A furniture article according to claim 14, wherein a tension screw is provided as the fixing element which is held in the supporting plate and is applied to it from below and to which a corresponding threaded bore is assigned in the supporting plate.

16. A furniture article, comprising:

first and second leaf sections;

first and second support arms fixedly coupled to said first and second leaf sections, respectively;

a cross traverse rotatably coupled about a stationary center axis and rotatably coupled to each of said first and second support arms;

first and second coupling rods rotatably coupled to each of said first and second support arms, respectively, said first and second coupling rods being rotatable about respective first and second stationary bearing points located on a pull-out axis which intersects with and is perpendicular to said center axis.

17. A furniture article according to claim 16, wherein said cross traverse, said first support arm, and said first coupling rod define a first parallelogram, and said cross traverse, said second support arm, and said second coupling rod define a second parallelogram.

18. A furniture article according to claim 16, wherein said first and second stationary bearing points are located at an identical distance from said center axis.

19. A furniture article according to claim 18, wherein said cross traverse is rotatably coupled about said stationary center axis proximate a central point of said cross traverse, opposite longitudinal ends of said cross traverse being rotatably coupled to said first and second support rods at respective first and second bearing points located proximate respective first longitudinal ends of said support rods, said first and second leaf sections being fixedly coupled to said support rods proximate respective second longitudinal ends of said support rods, said first and second coupling rods being rotatably coupled to said first and second support arms at respective third and fourth bearing points, said first and third bearing points being spaced at said identical distance, and said second and fourth bearing points being spaced at said identical distance.

20. A furniture article according to claim 16, wherein said first and second leaf sections have first and second separating edges each aligned perpendicular to said pull-out axis and parallel to each other.

21. A furniture article according to claim 20, wherein said first and second leaf sections are movable between an inoperative position in which said separating edges are adjacent each other and a pull-out position in which said separating edges are spaced at a distance from each other, said first and second support arms remaining parallel to said pull-out axis throughout movement between said inoperative position and said pull-out position, and said separating edges remaining parallel to each other throughout movement between said inoperative position and said pull-out position.

22. A furniture article, comprising:

a base;

first and second leaf sections;

first and second support arms fixedly coupled to said first and second leaf sections, respectively;

a cross traverse articulated on said base at a stationary center axis, said first and second support arms being articulated on said cross traverse proximate opposite longitudinal ends of said cross traverse, respectively;

first and second coupling rods being rotatable about respective first and second stationary bearing points, said first and second coupling rods being articulated on each of said first and second support arms, respectively, such that said first and second coupling rods are parallel to said cross traverse.

23. A furniture article, comprising:

first and second leaf sections movable between an inoperative position and a pull-out position;

first and second support arms non-rotatably coupled to said first and second leaf sections, respectively, said first and second support arms being parallel to a pull-out axis; and at least two guiding elements being rotatably coupled to each of said first and second support arms, each of said guiding elements being rotatable about a respective stationary bearing point located on said pull-out axis, such that said first and second support arms remain parallel to said pull-out axis throughout movement between said inoperative position and said pull-out position.

24. A furniture article according to claim 23, wherein said support arms and said guiding elements are arranged such that each of said leaf sections are displaced along a curved control path between said inoperative position and said pull-out position.

* * * * *